United States Patent [19]

Seragnoli

[11] 4,135,344

[45] Jan. 23, 1979

[54] DEVICE TO CHECK AND DISCARD LENGTHS OF WRAPPING MATERIAL (FOIL) IN VERY HIGH SPEED PACKET CIGARETTE PACKERS

[75] Inventor: Enzo Seragnoli, Bologna, Italy

[73] Assignee: G. D. Societa per Azioni, Bologna, Italy

[21] Appl. No.: 781,522

[22] Filed: Mar. 25, 1977

[30] Foreign Application Priority Data

Mar. 31, 1976 [IT] Italy ..... 3391/A76

[51] Int. Cl.[2] ..... B65B 57/12

[52] U.S. Cl. ..... 53/54; 209/535; 271/246; 53/64

[58] Field of Search ..... 209/71, 72, 73, 74 R, 209/74 M; 53/53, 54, 64; 271/245, 246

[56] References Cited

U.S. PATENT DOCUMENTS

| | | | |
|---|---|---|---|
| 2,922,519 | 1/1960 | Radley | 53/53 X |
| 3,416,289 | 12/1968 | Sebelin | 53/64 X |
| 3,637,203 | 1/1972 | French | 271/246 |
| 3,722,172 | 3/1973 | Seragnoli | 53/54 |
| 3,999,749 | 12/1976 | Zambolin et al. | 271/246 |

*Primary Examiner*—Joseph J. Rolla
*Attorney, Agent, or Firm*—Browdy and Neimark

[57] ABSTRACT

A device to check and discard lengths of wrapping paper (foil) intended to form the wrapper on packets of cigarettes in a very high speed packet cigarette packer; comprises at least one turning wheel in continuous motion on an axis parallel to the vertical feed plane for the lengths of wrapping paper and disposed opposite the front side of the stop check for the single lengths. Apparatus having idlers is placed, in respect to the feed plane, on the opposite side of the turning wheel in continuous motion mounted on an axis parallel to the axis of the wheel and spaced therefrom. An electromagnetic command controls the check for missing or faulty bundles of cigarettes. Mechanical linkage connects the idlers and the stop check with the means of command, so as to switch in respect of the vertical feed plane the stop check position and respectively on the idlers moving the former away from the same feed plane and bringing the second into contact with the turning wheel in continuous motion for the removal on the part of the aforesaid controls of any short or faulty bundle.

2 Claims, 2 Drawing Figures

DEVICE TO CHECK AND DISCARD LENGTHS OF WRAPPING MATERIAL (FOIL) IN VERY HIGH SPEED PACKET CIGARETTE PACKERS

FIELD OF THE INVENTION

The present invention relates to feed apparatuses for wrapping material in very high speed packet cigarette packers and more particularly concerns a device to check and discard lengths of wrapping material (foil) intended to make up the inner wrapper of these packets.

BACKGROUND OF THE INVENTION

In known machines, e.g., applicants machines for packeting bundles of cigarettes in soft or American and hinged lid type packets respectively capable of a production speed of 400 packets per minute, the bundles of cigarettes are transferred from their bundling zone to packing zone by a compartment conveyor belt with intermittent movement forwards.

During this transfer in the conveyor stationary phase, every compartment is subject, in a set position, to the action of a control device checking the bundle of cigarettes for missing or short or even for faulty cigarettes in the bundle. See for example applicant's U.S. Pat. No. 3,520,394.

In case of finding a faulty bundle, the control device actuate an expulsion device placed further down along the same conveyor in order for the faulty bundle to be taken out.

Further, as known and described in applicant's U.S. application Ser. No. 721,531, now abandoned, in the event of any drawbacks emerging, the control device also sends a stop command to the various wrapping materials feed lines so as to halt the assembly of elements for wrapping the missing or faulty bundle.

In other words the length of foil, the label for the outer wrapper and the State seal intended to cover a bundle of cigarettes missing or expelled because faulty are held with feed lines stationary to await the next fault-free bundle.

This manner of proceeding, without considering the case outside the present context of feed lines for the outer wrappers or labels and State seals, has some negative effects inherent in the structure and behaviour of the foil feed line on the running and output of the packer. The apparatus intended to supply the lengths of foil is in fact particularly complicated, as may be appreciated from the applicant's patent application Ser. No. 721,531, now abandoned, comprising a high number of elements in continuous rotatory movement at the very high speed packer drive.

The high inertia of the masses involved prevents either instant stopping of the apparatus after the missing or faulty bundle has been found or sufficiently fast resumption of work after the pause. As a result when the control devices signal an empty compartment or faulty bundle of cigarettes, the packer is made to run for a suitable time interval at a speed below working level. This has the advantage of helping stop the feed line and thus picking up normal working in stages through an intermediate low speed phase, nonetheless presents the serious drawback of the negative effect on packer output.

SUMMARY OF THE INVENTION

The purpose of the present invention is therefore to make a device which can let the feed line for the lengths of foil and thus the packer run at working speed to keep normal output rhythm even under the conditions above.

A further purpose of the present invention is to make a particularly simple and economical device.

These and still other purposes are all achieved with the device of the present invention to check and discard lengths of wrapping material (foil) in very high speed packet cigarette packers, comprising a compartmental conveyor with intermittent movement to feed bundles of cigarettes from their bundling zone to a final position previous to their transfer to a first wrap station. Control apparatus is placed along the conveyor to check for anything missing or faulty in the bundles. An expulsion mechanism is placed along the same conveyor on the down side of the controls and commanded by the same controls to remove any faulty bundles. A feed line for the lengths of wrapping material up to a stay position along a vertical plane is comprised between the final position of the bundle of cigarettes and the first wrap station and comprises stop and check means in respect of the bundle of cigarettes for the single lengths along the vertical plane, and means to transfer the single bundles of cigarettes together with a length of wrapping material from the final position to the first wrap station. The device features at least one turning wheel in continuous motion on an axis horizontal and parallel to the vertical feed plane tangential to it on the top side of the stop check, having idlers placed in respect of the feed plane on the opposite side of the turning wheel in continuous motion mounted on an axis parallel to the axis of the wheel up to and away from it. A means of command by electromagnetic action serves the control apparatus. Mechanical links for the idlers and the stop check are actuated by the means of command so as to switch in respect of the vertical feed plane the position of the stop check and respectively the idlers moving the first away from the same feed plane and bringing the second into contact with the turning wheel in continuous motion in order to remove a missing or faulty bundle by means of the controls.

BRIEF DESCRIPTION OF THE DRAWINGS

Further characteristics and advantages will appear more evident from the detailed description that follows of a preferred but nonexclusive embodiment of the invention illustrated purely for the sake of example in the drawings annexed in which.

DESCRIPTION OF THE PREFERRED EMBODIMENT

Figures 1, 2:
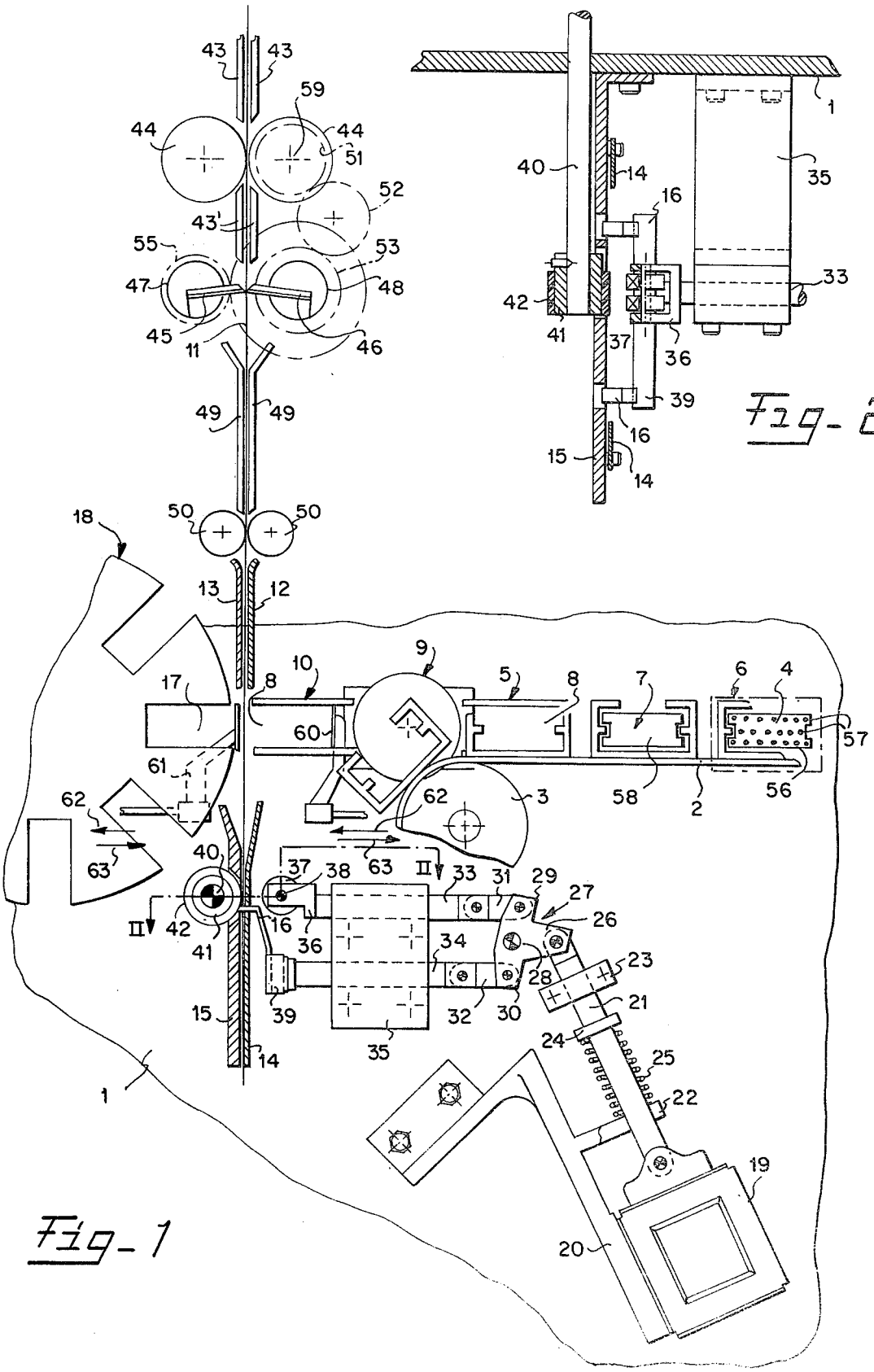
FIG. 1 shows a side view of part of a packet cigarette packer comprising the device of the invention and FIG. 2 shows a view from above on the line II—II of the device in FIG. 1.

With reference to the figures, a wall forms part of the base of a packet cigarette packer of the type described for example in applicant's U.S. Pat. Nos. 3,628,309 and 3,948,115, as well as in application Ser. No. 611,885, now abandoned.

A conveyor belt 2 with intermittent movement turning in a ring on wheels 3 (one only visible in FIG. 1) has compartments 4 capable of taking complete bundles of cigarettes laid crossways to the belt forward direction.

At each conveyor stop corresponding to a position marked 5, a bundle found to be perfect at control station 6 and therefore not expelled at station 7 according to the U.S. Pat. No. cited above 3,520,396 is transferred with onward movement in the direction of the axes of the cigarettes, by known means not represented, from compartment 8 (to the right as you look at FIG. 1) on a turning head 9 to two compartments diametrically opposite each other turning at intervals counter clockwise round a horizontal axis.

Rotating 180 degrees the bundle of cigarettes is transferred to position 10 next to the vertical feed plane for the wrapping material (foil) intended to make up the inner wrapper of the packet.

The continuous roll of foil is turned on a winder then subdivided into lengths 11 by means of apparatus not shewn in the figure as described in the patent application cited above Ser. No. 721,531, now abandoned.

Lengths 11 are then guided along the said feed plane by vertical guides 12 and 13 to reach their zone of utilization next to position 10.

In this zone every length 11 is held at the topside between the lower ends of guides 12 and 13 and at the lower side between the ends of the feed-in to the vertical guides 14 and 15 supported at the ends of its lower edge by two platelets 16 for stopping and checking inserted in the feed plane through an opening made in guide 14.

Pusher devices, not shown in the figures, having horizontal alternating movement, expel the bundle of cigarettes from turning head 9 carrying it to intercept the length 11 in stay position in the said zone of utilization and thus into a compartment 17 of the turning head 18 in stay position. As is known the turning head 18 mounted on a horizontal axis and rotating intermittently clockwise provides in combination with fixed and moving means for folding, as described in the U.S. patents cited above U.S. Pat. Nos. 3,628,309 and 3,368,115, and application Ser. No. 611,885, now abandoned, for putting the inner foil wrapper round the bundle of cigarettes.

In FIG. 1 an electromagnet 19 is fixed by bracket 20 to wall 1. A spindle 21 is fixed at the lower end to the anchor of the electromagnet 19 and can slide axially between guide elements 22 and 23 joined respectively to bracket 20 and wall 1.

Around spindle 21, interposed between ring 24 fitted over it and guide element 22, is wrapped contrast spring 25.

On the upper end spindle 21 fulcrums on arm 26 of T lever 27 set at 28 on wall 1 on the right of the vertical feed plane as you look at FIG. 1.

The two counter opposing arms 29 and 30 of T lever 27 are in turn connected respectively through links 31 and 32 to spindles 33 and 34 normal to the vertical feed plane and supported to slide on block 35 joined to wall 1. The free end of spindle 33 supports through fork 36 the two idlers 37 mounted on the same axis 38 normal to wall 1. On the free end of spindle 34 is fixed in turn normal to wall 1 the small bar 39 the ends of which are joined to platelets 16 mentioned above.

Lastly a turning shaft 40 in continuous motion protrudes from wall 1 on the left of guide 15 parallel to and in horizontal alignment with axis 38. At the end of the shaft 40 facing idlers 37 there is joined wheel 41 covered with a sheath of rubber or other elastic material and of such dimensions as to be tangential to the vertical plane of the foil feed through an opening made in guide 15.

In normal conditions, that is when compartments 4 are occupied by correct bundles of cigarettes, electromagnet 19 is activated and thus overcoming the resistance of spring 25 exerts force on traction on spindle 21 and therefore arm 26 of T lever 27.

In consequence of which spindle 34 is thereby in condition to advance in respect of the feed plane and platelets 16 inserted between guides 14 and 15 fulfil the function previously defined to stop check the lengths 11 of foil. Spindle 33 on the other hand under such conditions is in retract position in respect of the vertical feed plane and idlers 37 stand off from guides 14 and 15. If the control devices set along conveyor find an empty compartment or bundle of cigarettes which is short or faulty, the same control device besides warning the expulsion device placed further down along conveyor 2 sends with a delay in machine time function corresponding to the distance between control station 6 and position 10, a command to disengage electromagnet 19.

In consequence spindle 21 through pressure of spring 25 slides axially upwardly making T lever 27 rotate counter clockwise round its fulcrum 28.

Spindle 34 slides from left to right with consequent extraction of platelets 16 from the foil feed plane whereas spindle 33 sliding from right to left brings the idlers 37 into contact with sheath 42 of wheel 41. Idlers 37 and motorized wheel 41 provide in combination between them, in coincidence with the advent in position 10 of a compartment 8 empty of its bundle of cigarettes, for taking the length of foil 11 towards a discard position placed at the lower end of guides 14 and 15.

It is evident how through the device of the invention the purposes set out in the foregoing may be achieved and how its use allows the foil feed in a packet cigarette packer to run at working speed even when checks on conveyor 2 reveal empty compartments or short bundles or faulty cigarettes.

The control and expulsion means can be constructed as shown in the above-mentioned U.S. Pat. No. 3,520,394. As shown in FIG. 1, these means are shown somewhat schematically in operative association with other parts. As illustrated, laterally with respect to the conveyor 2 at the same level of the compartments 4, two support members 56 for a group 57 of sensors are disposed, in front one another. The sensors of the group 57 are arranged, one for each cigarette, in alignment with the position that the latter will occupy in a batch intended to form a packet.

The absence of one or more cigarettes or the irregularities amongst these, indicated by any one of the sensors, is sensed by at least one sensor of the group 57 which closes electrical contacts (not shown) in the electrical feeding circuit of the movement means (not shown) of a pusher 58 (expulsion means) alternately movable transversely to the conveyor 2 and disposed downstream from the sensor group 57, according to the movement direction of the conveyor 2 and in an electrical feeding circuit of the electro-magnet 19.

As described generally above, when a sensor of the group 57 indicates the aforementioned absence of cigarettes or irregularities besides activating the pusher 58, it sends, with a delay in machine time function corresponding to the distance between the control station 6 and the position 10, a command to disengage the electromagnet 19.

The feed line for the lengths 11 of material can be conventional. A possible feed line for the lengths 11 of wrapping material comprises guide means 43-43'-49 and 12, 13 for the strip of wrapping material unwound from a bobbin (not shown). Between the guide means 43, 43' a first pair of rollers 44 is disposed, in side by side relationship, which unwinds the strip of wrapping material from the bobbin and feeds the unwound strip to cutting rollers 47, 48, disposed downstream from the guide means 43'. Cutting edges 45 and 46 respectively are provided on the rollers 47, 48 for the subdivision into lengths of the strip of wrapping material. A pair of rollers 50, in side by side relationship, disposed downstream the cutting rollers 47, 48 and the guide means 49, feeds the lengths 11 of wrapping material cut by the cutting edges 45, 46 to the zone of utilization, position 10.

A mechanism including gear wheels 51-52-53-54-55 effects transfer of the movement from a motorized shaft 59 to the roller 44 and to the cutting rollers 47, 48. The roller 50 can be driven independently or through a mechanism (not shown) connected to the shaft 59.

The transfer means for moving the bundle and wrapping sheet into the wrapping station can be constructed according to U.S. Pat. Nos. 3,628,309 and 3,948,115. For example, a pusher 60 and a counter-pusher 61 movable in synchronism alternately in direction as indicated by the arrows 62-63. The pusher 60 and counter-pusher 61 (see aforementioned patents), are disposed respectively inside the rotatable heads 9, 18 and are movable in phase with the movement thereof.

I claim:

1. A device to check and discard lengths of wrapping material in high speed packet cigarette packers, comprising a conveyor with compartments having intermittent movement to feed bundles of cigarettes from their bundling zone to a final position previous to their transfer to a first wrap station, controls placed along the said conveyor to check for missing or faulty bundles, means of expulsion placed along the same conveyor downstream of said controls and commanded by them for rejecting faulty bundles, a feed line for feeding the lengths of wrapping material to a stay position along a vertical plane between said final position of the bundle of cigarettes and said first wrap station and comprising a stop check for the single lengths fed along said vertical plane disposed adjacent the final position of the bundle of cigarettes, and means to transfer the single bundles of cigarettes together with a length of wrapping material from said final position to said first wrap station which device includes at least one turning wheel in continuous motion on an axis and parallel to said vertical feed plane and adjacent to it on the front portion of said stop check, idlers placed with respect to said feed plane on the opposite side of the said turning wheel in continuous motion, mounted on an axis parallel to the axis of said wheel and spaced therefrom, a means of command by electromagnetic action for said controls, mechanical links for the idlers and the stop check coupled to said means of command, so as to switch with respect to said vertical feed plane the positions of said stop check and idlers, rspectively, by displacing the first from said feed plane and bringing the second into contact with said turning wheel in continuous motion for the removal on the part of the aforesaid controls of a length of wrapping material corresponding to a bundle which is missing or faulty.

2. A device according to claim 1, wherein said stop check and said idlers are associated at one end with corresponding spindles, the other ends of which are articulated to ends of two arms counter positioned on a three arm fulcrum balance oscillating on a fixed point, the free end of the third arm of said balance rotating at the command of said electromagnetic control means.

* * * * *